US005746657A

United States Patent [19]

Ueno

[11] Patent Number: 5,746,657

[45] Date of Patent: May 5, 1998

[54] OFF-TRACK BETTING SYSTEMS

[75] Inventor: Teruo Ueno, c/o Royal Housing, Inc., 9-11, Sougawa 3-chome, Toyama-shi, Toyama-ken, Japan

[73] Assignees: Teruo Ueno; Royal Housing, Inc., both of Toyama-ken, Japan

[21] Appl. No.: 602,452

[22] Filed: Feb. 16, 1996

[30] Foreign Application Priority Data

Feb. 16, 1995 [JP] Japan ..... 7-053355
Feb. 22, 1995 [JP] Japan ..... 7-059852

[51] Int. Cl.[6] ..... G06G 7/48

[52] U.S. Cl. ..... 463/41; 463/25

[58] Field of Search ..... 463/25, 26, 27, 463/28, 30, 31, 32, 34, 40, 41, 42; 370/242

[56] References Cited

U.S. PATENT DOCUMENTS 3,697,698 10/1972 Oswald et al. ..... 370/242
4,322,612 3/1982 Lange ..... 463/28
5,564,977 10/1996 Algie ..... 463/30

*Primary Examiner*—George Manuel
*Attorney, Agent, or Firm*—Birch, Stewart, Kolasch & Birch, L.L.P.

[57] ABSTRACT

The present invention relates to an off-track betting system comprising receiving means for receiving live racing from a race track, display means for displaying the received live racing so that unspecified bettors can watch the race, and betting means for enabling the bettors to enter bets on the outcome of the race displayed on said display means through a TV telephone or facsimile. The present invention further relates to an off-track on-line betting system comprising receiving means for receiving live racing from a race track, display means for displaying the received live racing so that unspecified bettors can watch the races, and betting means for enabling the bettors to enter bets on the outcome of the race displayed on said display means

4 Claims, 5 Drawing Sheets

OFF-TRACK BETTING SYSTEMS

BACKGROUND OF THE INVENTION

The present invention relates to an off-track on-line betting system for a variety of races, which enables bettors to place bets on races run all over the country, while they watch them at ease, such as in their own homes.

A variety of races such as horse races, bike races, auto races, and speedboat races are now municipally operated all over the country. For off-track betting, each bettor must place a bet on the outcome of each race through an exclusive telephone betting system with which the bettor must be affiliated. To watch a race run at a remote place, the bettor must make a reception contract with an exclusive TV station and have receiving equipment installed in the house.

To watch races, bettors have so far had to visit the race tracks or make reception contracts with exclusive TV stations. However, much difficulty is involved in allowing each bettor to go to the races run substantially all over the country due to some considerable traffic expense and much time taken. For watching races on a monitor screen at home, too, some considerable expense and exclusive equipment are needed. Currently available telephone betting systems often have procedural difficulties because of the need of making an individual contract with an individual organization, possibly with an exclusive account to which a certain amount of guaranty money must be transferred. Watching races at home often presents some educational problems to persons under the legal age limit.

Simple telephone betting often causes trouble to bettors due to mishearing or other inadvertent reasons.

It is therefore an object of the present invention to provide an off-track, or off-track on-line betting system which makes it possible for bettors to enter bets on races run everywhere, including entering bets through a television-telephone or by facsimile, or through an on-line circuit with a race organization or association, while the bettors watch the races at ease as if in their own homes, with reliability, accuracy and safety.

SUMMARY OF THE INVENTION

According to the present invention, there is provided an off-track or off-track on-line betting system including receiving means for receiving live racing from each race track, display means for displaying the received live racing (i.e. so that unspecified bettors can watch the race), and betting means for enabling the bettors to enter bets on the outcome of the race displayed on said display means, for instance, through a TV telephone or facsimile.

In one preferable embodiment, the off-track or on-line betting system of the present invention is applied to a horse race, a bike race, a speedboat race or an auto race.

In another preferable embodiment, the on-line betting system of the present invention further includes banking means for enabling a race organization to receive a bet placed by each bettor and to transfer any winnings to, or deducting any money lost from, a common account.

In still another preferable embodiment, the off-track betting system of the present invention further includes banking means for enabling a race organization to receive a bet placed by a telephone betting contractor and to transfer any winnings to, or deducting any money lost from, an account corresponding to the telephone betting contractor.

According to the off-track, or off-track on-line betting system of the present invention, a race organization or association allows unspecified or unqualified bettors to enter bets on the live racing displayed on a monitor screen such as by means of a TV telephone or facsimile, while they watch the race at ease as if in their own homes.

TV telephone or facsimile betting ensures that mishearing or inadvertent operations can be prevented.

The race organization or association can use the banking means to receive bets placed by bettors or unqualified bettors and transfer any winnings to, or money lost on bets from, a common account.

DETAILED EXPLANATION OF THE PREFERRED EMBODIMENTS

Figure 1:
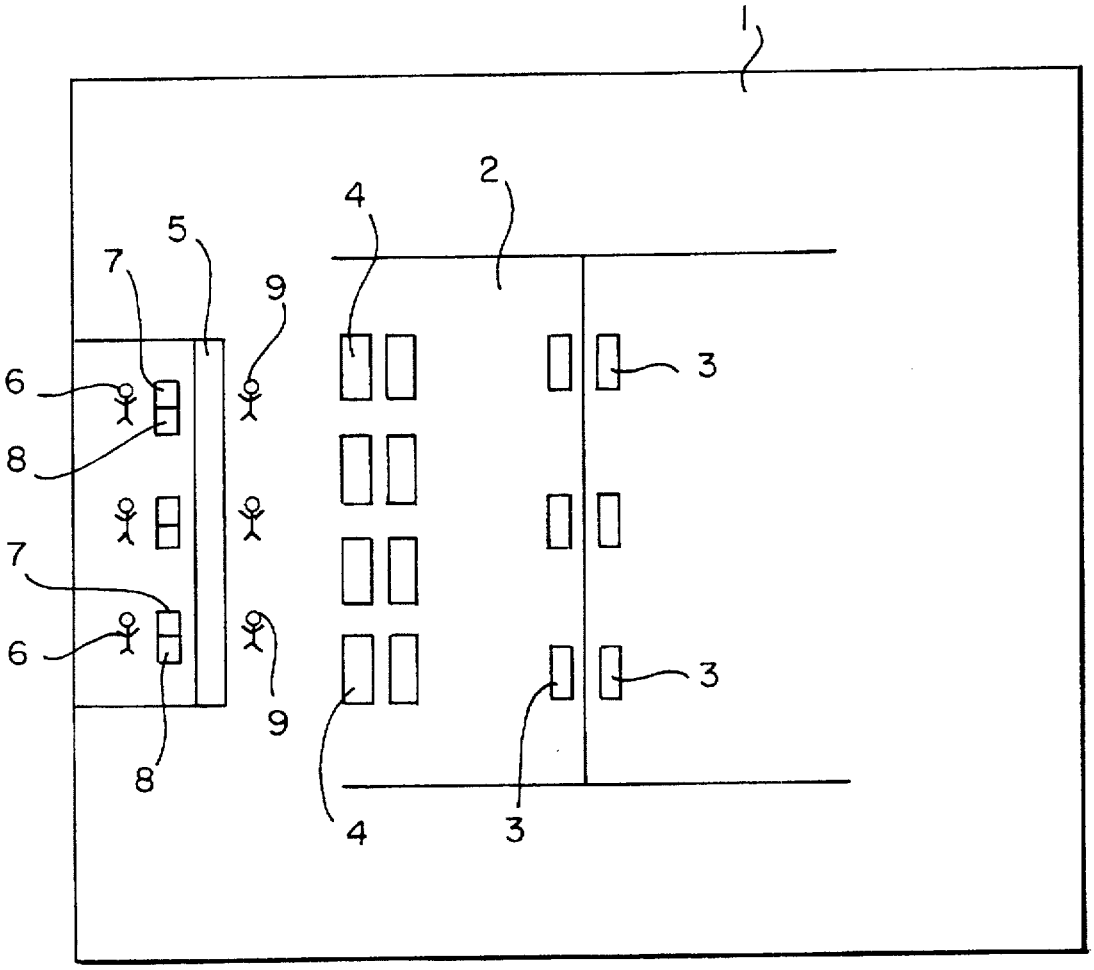
FIG. 1 is a plan view of one embodiment of a betting establishment with the present system installed therein.

The on-line betting system according to the present invention will now be explained with reference to FIGS. 1 and 2. As can be seen from FIGS. 1 and 2, the betting establishment or room shown generally at 1 accommodates a plurality of race-watching corners 2 of large capacity, each including a number of sofa benches 4 and a plurality of large monitor screens 3 on which races run at different tracks are displayed.

Each race-watching corner 2 includes a reception counter 5 with an attendant operator 6.

In the betting room 1, the race-watching corner 2 associated with the reception counter 5 is located for each type of race, i.e., a horse race, a bike race, a speedboat race, and an auto race.

Figure 3:
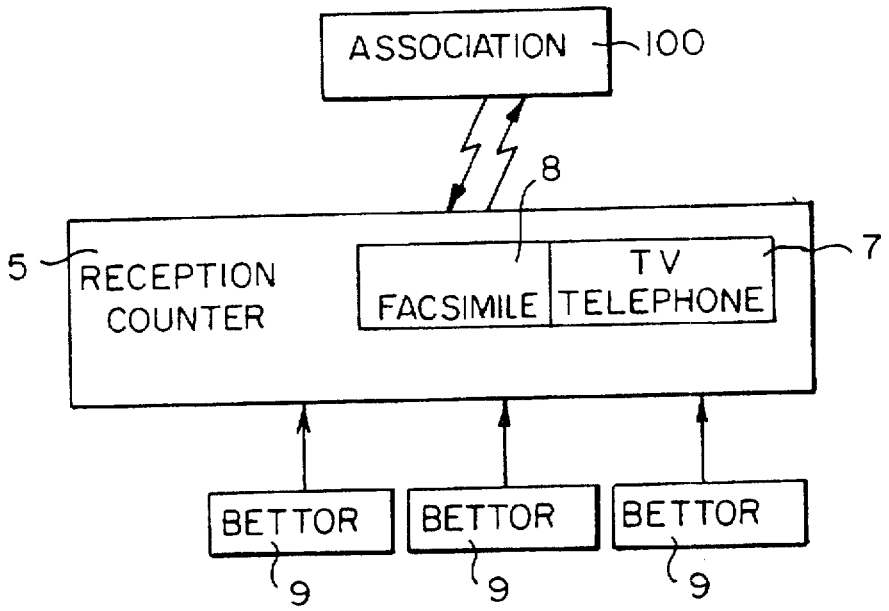
FIGS. 3 and 5 are diagrams illustrating embodiments of the present system.

In FIGS. 1 and 3, each reception counter 5 includes exclusive TV telephones 7 and facsimiles 8. On demand, the operator 6 enters a bet placed by bettors 9 or 10 on the race operated by an association 100 through the preselected TV telephone 7 and facsimile 8.

Figure 2:
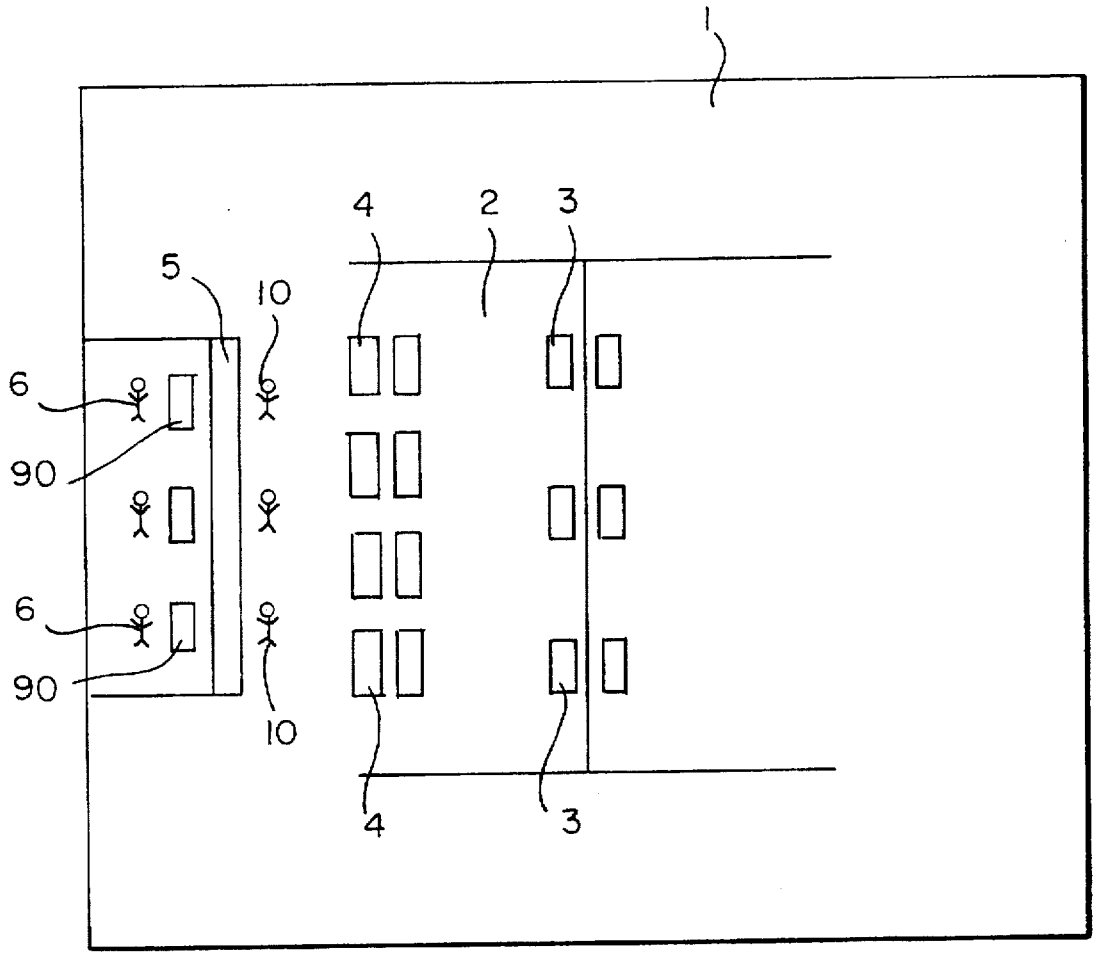
FIG. 2 is a plan view of another embodiment of a betting room with the present system installed therein.
Figure 5:
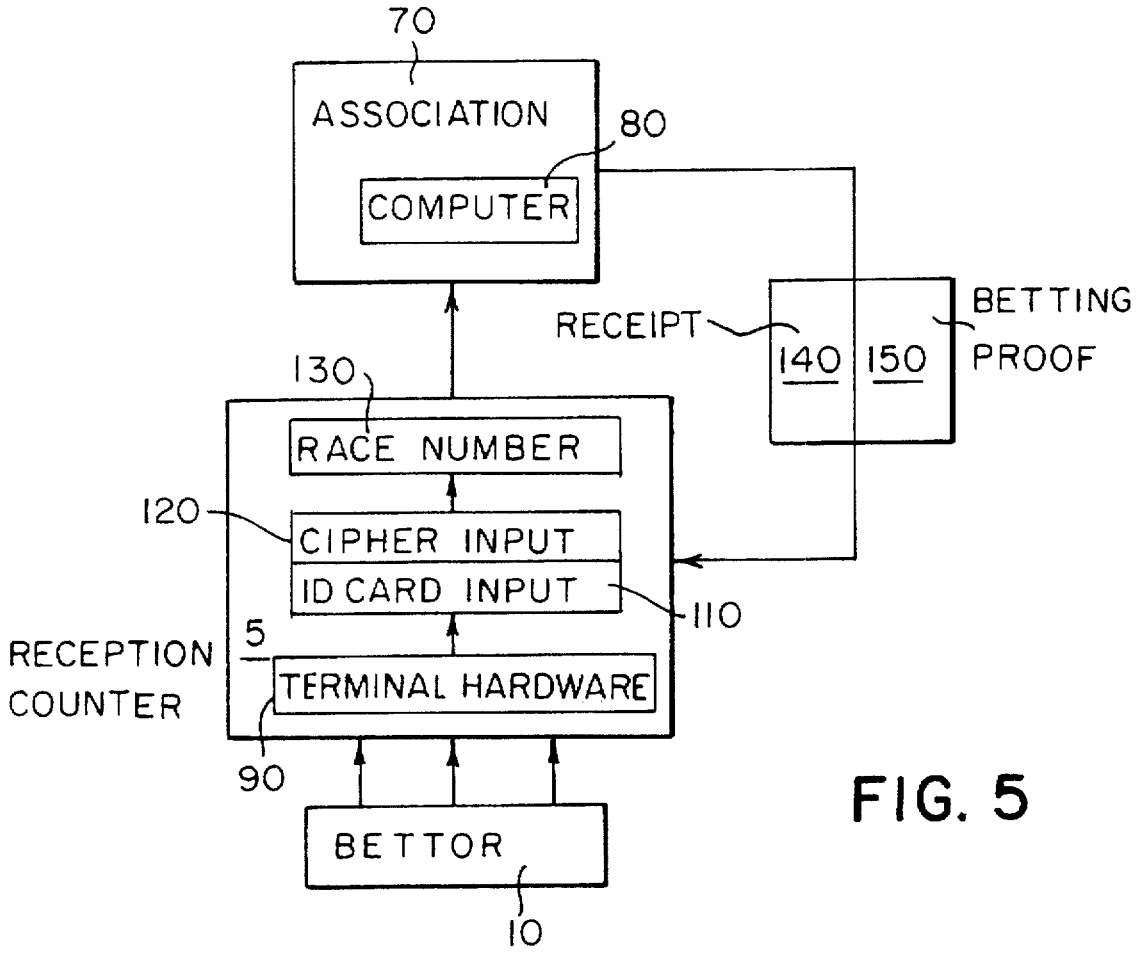

In FIGS. 2 and 5, each reception counter 5 includes terminal hardware 90 connected to a computer 80 installed at a race-operating association 70. On demand by the bettor 10, the operator 6 enters a preselected ID card 110 and cipher 120 of the bettor into the terminal hardware 90 to place a bet on the race, as shown at 130. This information is transmitted to the association 70 which, in turn, returns a receipt 140 and a betting proof 150 back to the terminal hardware 90.

Figure 4:
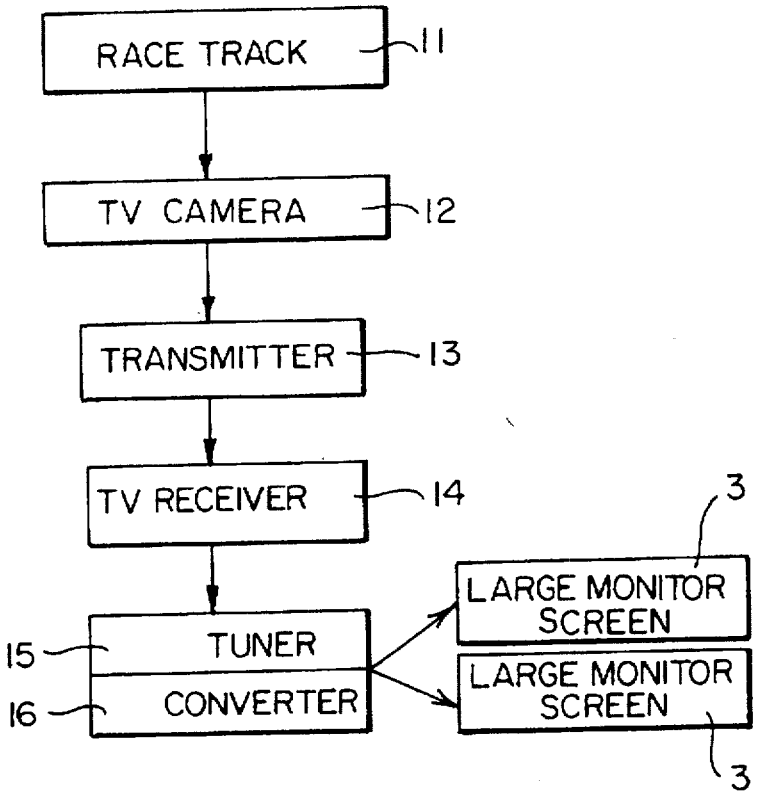
FIG. 4 is a diagram illustrating part of the present system from a race track to displaying the race on a TV monitor screen.

FIG. 4 illustrates part of the system from a particular race track to televising live racing. Live racing at a race track 11 is transmitted from a TV camera 12 to each part of the country through a transmitter 13, where a TV receiver 14 set on the telephone betting contractor side or on the on-line betting contractor side can receive the race for displaying it on each large monitor screen 3 through a tuner 15 and a converter 16.

As a matter of course, each race is operated by the association 70 or 100 which, in turn, manages gains and winnings.

Figure 6:
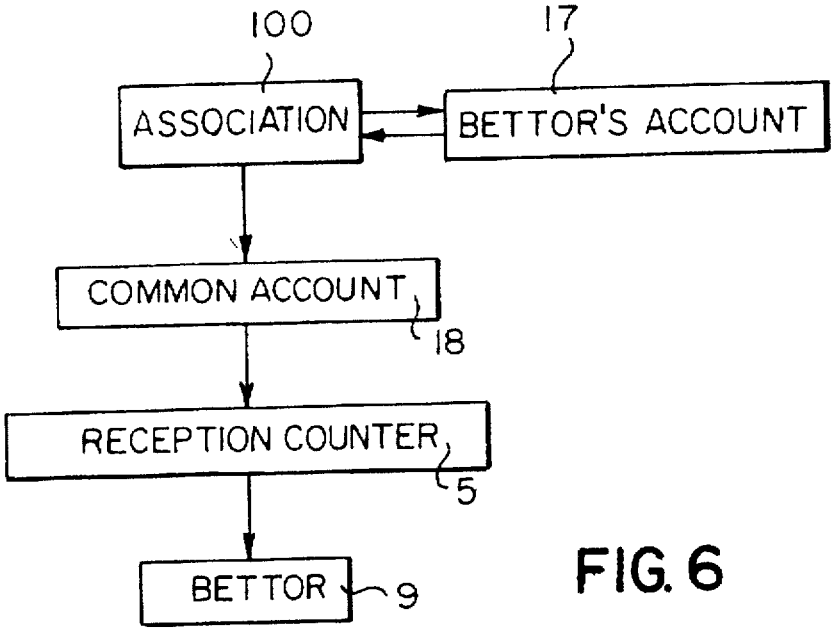
FIG. 6 is a flow chart of bets and winnings through the present system.
Figure 7:
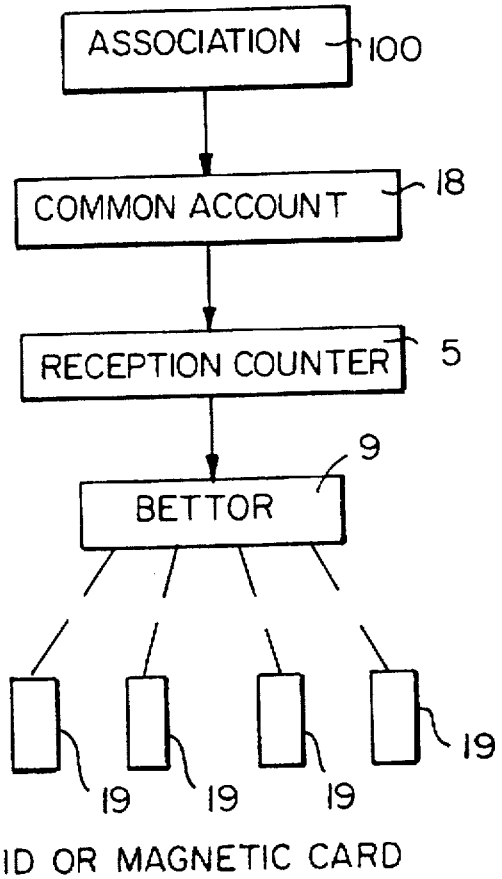
FIG. 7 is a flow chart of bets and winnings through the present system.
Figure 8:
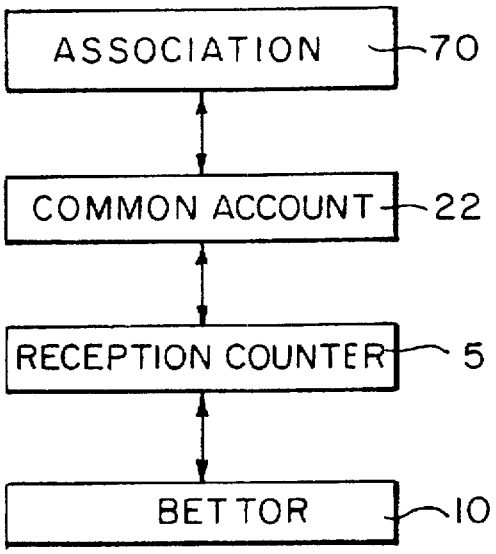
FIG. 8 is a flow chart of bets and winnings through the present system.

In FIGS. 6–8, a qualified bettor, who has already been enlisted in the telephone betting system, may place a bet on the race through a telephone installed in the betting room 1 or a public telephone provided elsewhere. The amount of money to be bet is deducted by the association 100 or 70 from the bettor's own account 17, and winnings, if any, are transferred by the association 100 or 70 to the account 17. This telephone betting system is prescribed for each type of race, i.e., a horse race, a bike race, a speedboat race, and an auto race.

An unqualified bettor (i.e. which has not been enlisted in the telephone betting system, when one is present) can ask the operator 6 at the reception counter 5 in each race-watching corner 2 to enter a bet on the race. Such an unqualified bettor can place a bet on the race in much the same manner as the qualified bettor, if temporarily allowed to be enlisted in the telephone betting system or in the on-line betting system.

In the case of plural such unqualified bettors, they can temporarily be enlisted in the telephone betting system, or in the on-line betting system through a common account 18, so that they can individually place a bet on the race through the operator 6. To discriminate them individually, the operator 6 can then issue an ID or magnetic card 19 to each bettor.

As can be seen from FIGS. 6–8, the amount of cash on hand to be bet is paid to the operator 6, and winnings, if any, are transferred to a common account 18 or to a preselected account 22 at the reception counter 5.

When transferred to the common account 18 or to the preselected account 22, the winnings are paid to each bettor 10 having the ID or magnetic card 19 through the operator or receptionist 6.

The ID or magnetic card 19 used may have a storage function to ensure that the number of the horse or the like bet by the bettor 9 or 10, and any winnings (of course, any money lost on bets that did not win) can precisely be processed.

The off-track betting system according to the present invention may be operated using, in addition to an exclusive betting establishment capable of accommodating a number of bettors, etc., such as shown in FIGS. 1 or 2, a restaurant or sauna facilities, each including a "karaoke" establishment, and an outdoor prefabricated betting establishment. For televising/receiving equipment, terrestrial waves, fiber cables, and satellite uplink broadcasting may be used.

As explained above, the present invention enables bettors to place bets on races run at every part of the country, while they watch them at ease as if in their own homes, with no traffic expense. Even an unqualified bettor can enter a bet on any desired race, if the bettor makes a temporal contract with the telephone or facsimile betting system or with the on-line betting system Thus, the off-track betting system of the present invention eliminates the need for bettors to have receiving/televising equipment and telephone betting equipment at home, and provides a solution to educational problems. Also, the off-track betting on-line system of the present invention eliminates the need for bettors to have receiving/televising equipment and on-line equipment at home, and provides a solution to educational problems.

The betting system of the present invention ensures that bettors can place bets on races through a TV telephone or facsimile with safety yet at ease as if in their own homes.

Similarly, the on-line betting system of the present invention ensures that bettors can place bets on races with safety yet at ease as if in their own homes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The entirety of JP-7-53355 filed Feb. 16, 1995, and JP-7-59852, filed Feb. 22, 1995, from which priority under 35 USC 119 is claimed, are incorporated herein by reference

What is claimed is:

1. An off-track betting system comprising:

receiving means for receiving live racing from a race track, display means for displaying the received live racing so that unspecified bettors can watch the race, betting means for enabling the bettors to enter bets on the outcome of the race displayed on said display means through a TV telephone or facsimile, and banking means for enabling a race organization to receive bets placed by the bettors and to transfer any winnings to or deduct any money lost from the bettors' accounts.

2. The off-track betting system according to claim 1, wherein the live racing is from a horse race, a bike race, a speedboat race or an auto race.

3. An off-track on-line betting system comprising:

receiving means for receiving live racing from a race track, display means for displaying the received live racing so that unspecified bettors can watch the race, betting means for enabling the bettors to enter bets on the outcome of the race displayed on said display means through a TV telephone or facsimile, and banking means for enabling a race organization to receive bets placed by the bettors and to transfer any winnings to or deduct any money lost from the bettors' accounts.

4. The on-line betting system according to claim 3, wherein the live racing is from a horse race, a bike race, a speedboat race or an auto race.

* * * * *